US007105994B2

(12) United States Patent
Minami et al.

(10) Patent No.: US 7,105,994 B2
(45) Date of Patent: Sep. 12, 2006

(54) COLOR CATHODE RAY TUBE AND SHADOW MASK SUPPORT

(75) Inventors: Go Minami, Takatsuki (JP); Hirotoshi Watanabe, Suita (JP); Hiroshi Aono, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 342 days.

(21) Appl. No.: 10/764,030

(22) Filed: Jan. 22, 2004

(65) Prior Publication Data

US 2004/0150313 A1 Aug. 5, 2004

(30) Foreign Application Priority Data

Feb. 5, 2003 (JP) ..... 2003-028039

(51) Int. Cl.
*H01J 29/07* (2006.01)

(52) U.S. Cl. ..... 313/407; 313/402; 313/404

(58) Field of Classification Search ..... 313/402, 313/404, 407
See application file for complete search history.

(56) References Cited

U.S. PATENT DOCUMENTS

2002/0125809 A1* 9/2002 Wilk ..... 313/407
2004/0189179 A1* 9/2004 Karita et al. ..... 313/407

FOREIGN PATENT DOCUMENTS

JP 2001-176420 6/2001

* cited by examiner

*Primary Examiner*—Nimeshkumar D. Patel
*Assistant Examiner*—Matt Hodges
(74) *Attorney, Agent, or Firm*—Hamre, Schumann, Mueller & Larson, P.C.

(57) ABSTRACT

A first frame includes a bottom portion, an inclined portion, a joint portion and a lateral portion for supporting a shadow mask. Between the lateral portion and the joint portion, a space is provided except where the lateral portion and the joint portion are welded. The joint portion is inclined with respect to the lateral portion such that the space enlarges with an increase in the distance from an edge of the lateral portion on the side of supporting the shadow mask. With this configuration, foreign substances can be removed from between the lateral portion and the joint portion in the process of cleaning the first frame, making it possible to both suppress the deterioration of high-voltage withstand capabilities of a color cathode ray tube and prevent the poor welding of the first frame.

4 Claims, 4 Drawing Sheets

COLOR CATHODE RAY TUBE AND SHADOW MASK SUPPORT

BACKGROUND OF THE INVENTION

1. Field of the Invention

The present invention relates to a color cathode ray tube. In particular, the present invention relates to the shape of a frame for supporting a shadow mask, which is an element of a color cathode ray tube.

2. Description of Related Art

FIG. 6 is a perspective view showing a color selection mechanism of a conventional color cathode ray tube. As shown in FIG. 6, the color selection mechanism of the conventional color cathode ray tube includes a shadow mask 101, a pair of first frames 102 for stretching and supporting the shadow mask 101, and a pair of second frames 103 for supporting the pair of first frames 102 (see JP 2001-176420 A, for example).

As shown in FIG. 7, the first frame 102 is formed to have a substantially triangular cross-section and includes a bottom portion 105, an inclined portion 106, a joint portion 107 and a lateral portion 104 for supporting the shadow mask 101. The lateral portion 104 has an edge 104*a* for stretching and supporting the shadow mask 101, and this edge 104*a* has an arc shape when viewed along a normal direction of the lateral portion 104. Further, the entire surface of the joint portion 107 on the side of the lateral portion 104, which is to overlap the lateral portion 104, contacts the lateral portion 104. At an edge 107*a* of the joint portion 107 on the side of the shadow mask, the joint portion 107 is connected to the lateral portion 104 by welding.

This first frame 102 is formed as follows. After a metal plate is pressed and folded so as to have a substantially triangular cross-section, any adherent foreign substances are cleaned, and then the joint portion 107 and the lateral portion 104 are welded together.

Thereafter, the first frames 102 are welded to the second frames 103 as one piece. Subsequently, after a blackening treatment, the shadow mask 101 is stretched along the edges 104*a* of the lateral portions 104 of the first frames 102.

However, in the conventional color cathode ray tube, since the entire surface of the joint portion 107 of the first frame on the side of the lateral portion 104 is in contact with the lateral portion 104, a cleaning agent cannot enter the space between the lateral portion 104 and the joint portion 107 in the subsequent process of cleaning the first frame. Accordingly, foreign substances such as unwanted oil and dust are not cleaned but remain in the first frame, causing a problem of deteriorating high-voltage withstand capabilities of the color cathode ray tube. Moreover, the above-described remaining foreign substances have brought about a problem that poor welding occurs at the time of welding the lateral portion 104 and the joint portion 107.

SUMMARY OF THE INVENTION

It is an object of the present invention to solve the problems described above and to provide a color cathode ray tube that can suppress the deterioration of high-voltage withstand capabilities and prevent a poor welding at the time of forming first frames.

A color cathode ray tube according to the present invention includes a shadow mask, first frames for supporting the shadow mask, and second frames for supporting the first frames. The first frames have a lateral portion for supporting the shadow mask and a joint portion that is overlapped on the lateral portion and welded partially to the lateral portion. A space is provided between the lateral portion and a part of the joint portion other than the part welded to the lateral portion. The joint portion is inclined with respect to the lateral portion such that the space enlarges with an increase in a distance from an edge of the lateral portion on a side of supporting the shadow mask.

DESCRIPTION OF THE PREFERRED EMBODIMENTS

In a color cathode ray tube according to the present invention with the above configuration, since a space is provided between the lateral portion and the joint portion of the first frame, a cleaning agent easily can enter the space in the process of cleaning the first frame. Thus, foreign substances remaining in the first frame can be cleaned easily, making it possible to both suppress the deterioration of high-voltage withstand capabilities of the color cathode ray tube and prevent the poor welding at the time of forming the first frames.

The following is a description of a color cathode ray tube of the present invention, with reference to FIGS. 1 to 5.

First Embodiment

Figure 1:
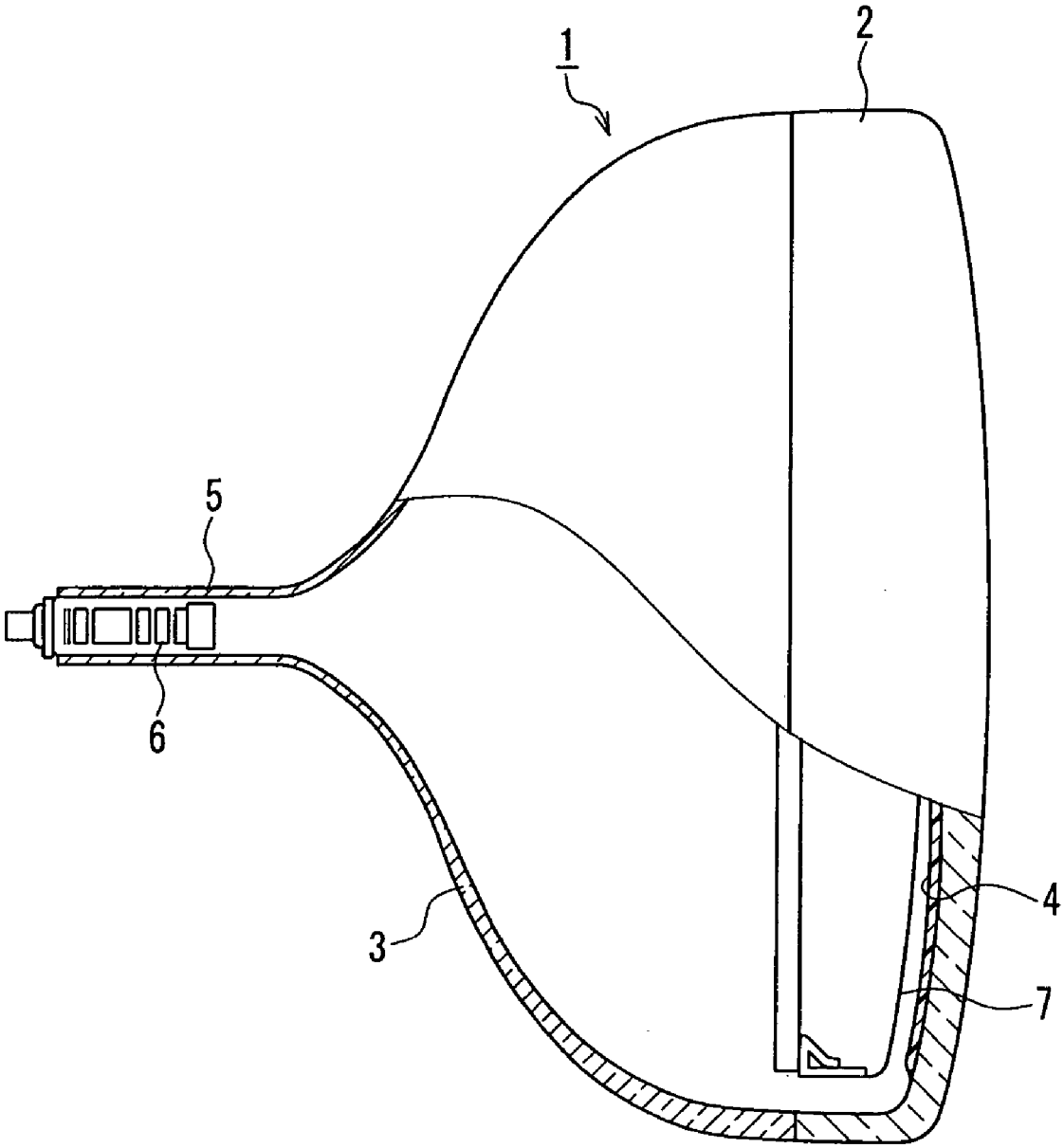
FIG. 1 is a partially sectional view showing a color cathode ray tube according to a first embodiment of the present invention.

FIG. 1 is a partially sectional view showing a color cathode ray tube according to the first embodiment of the present invention.

As shown in FIG. 1, a color cathode ray tube 1 according to the first embodiment of the present invention has an envelope including a panel 2 and a funnel 3. An inner surface of the panel 2 is provided with a phosphor screen 4 to which blue, green and red phosphors are applied. The funnel 3 has a neck portion 5 in which an electron gun 6 is enclosed. In addition, a color selection mechanism 7 is disposed so as to face the phosphor screen 4.

Figure 2:
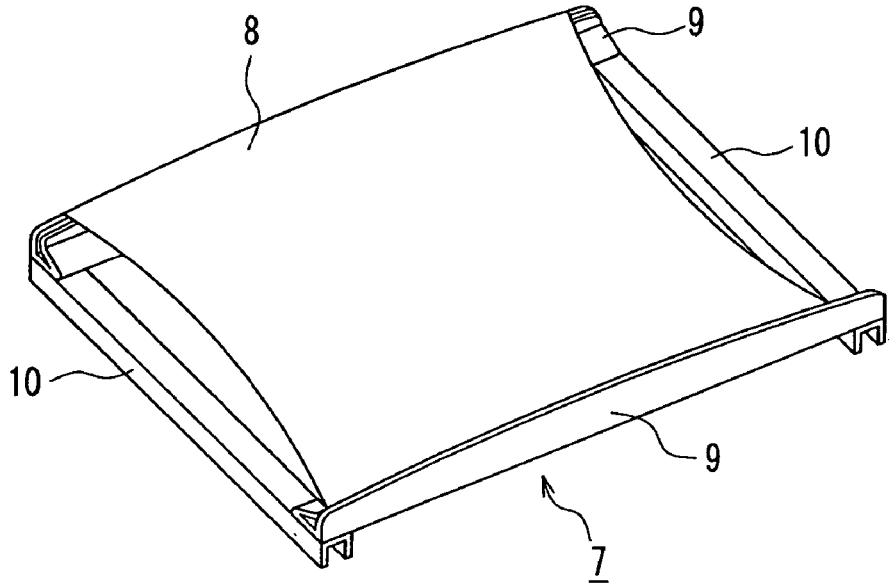
FIG. 2 is a perspective external view showing a color selection mechanism of the color cathode ray tube according to the first embodiment of the present invention.

As shown in FIG. 2, this color selection mechanism 7 includes a shadow mask 8, a pair of first frames 9 for stretching and supporting the shadow mask 8, and a pair of second frames 10 for supporting the pair of first frames 9.

Figure 3:
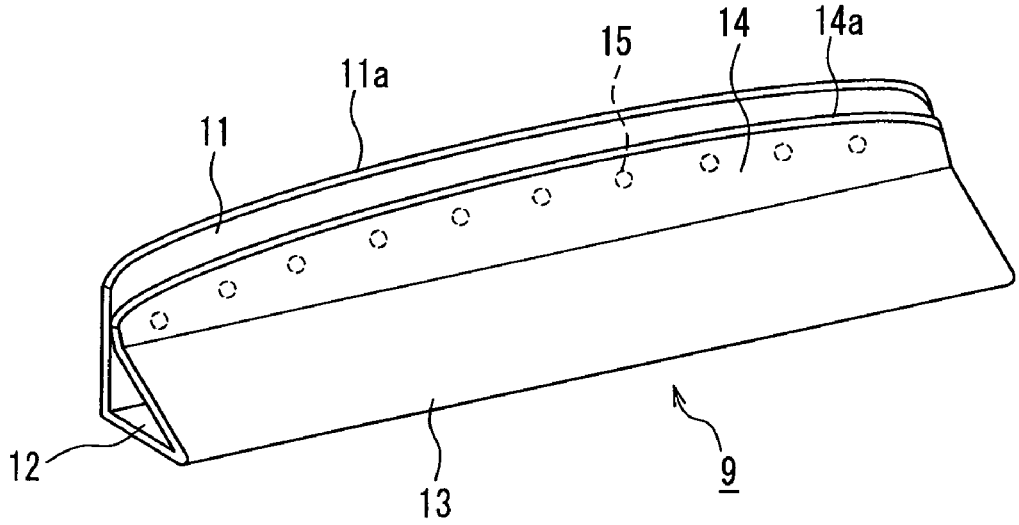
FIG. 3 is a perspective external view showing a first frame of the color cathode ray tube according to the first embodiment of the present invention.

As shown in FIG. 3, the first frame 9 includes a bottom portion 12, an inclined portion 13, a joint portion 14 and a lateral portion 11 for stretching and supporting the shadow mask 8 with its edge 11*a*. Also, the first frame 9 has a substantially triangular cross-section, which is formed by the lateral portion 11, the bottom portion 12 and the inclined portion 13. The joint portion 14 is overlapped on the lateral portion 11, and the joint portion 14 and the lateral portion 11 are connected by welding at an edge 14*a* of the joint portion 14 on the side of the shadow mask 8. The lateral portion 11 has the edge 11*a* for stretching the shadow mask 8, and this edge 11*a* has an arc shape seen along a normal direction of the lateral portion 11. Furthermore, the edge 14*a* of the joint portion 14 on the side of the shadow mask 8 also has an arc shape when viewed along a normal direction of the joint portion 14.

Moreover, the surface of the lateral portion 11 on the side of the joint portion 14 is provided with a plurality of equidistantly spaced protrusions 15 (shown by dotted lines in the figure) that contact the joint portion 14. These protrusions 15 are arranged substantially along an arc at a certain distance from the edge 14*a* of the joint portion 14.

This first frame 9 is formed as follows. By press working, a metal plate is bent and deformed into a predetermined shape and the protrusions 15 are provided at predetermined positions in a part to be the lateral portion 11. The metal plate is folded so as to have a substantially triangular cross-section, and then the joint portion 14 and the lateral portion 11 are welded together.

Figure 4:
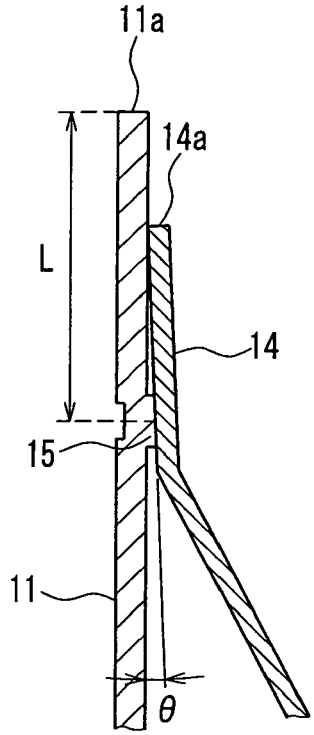
FIG. 4 is an enlarged sectional view showing a main portion of the first frame of the color cathode ray tube according to the first embodiment of the present invention.

FIG. 4 is an enlarged sectional view showing a main portion of the lateral portion 11 and the joint portion 14 including the protrusion 15.

As shown in FIG. 4, the tip of the protrusion 15 provided in the lateral portion 11 is in contact with the joint portion 14. Accordingly, the joint portion 14 is inclined at a certain angle θ with respect to the lateral portion 11. The lateral portion 11 and the joint portion 14 are welded together at the edge 14*a* of the joint portion 14 on the side of the shadow mask. Since a plurality of the protrusions 15 are provided so as to be spaced from each other in a longitudinal direction of the first frame 9, the angle θ that the joint portion 14 forms with the lateral portion 11 can be made substantially constant in the longitudinal direction. It should be noted that the protrusions 15 do not have to be provided as long as the base plate of the first frame 9 is folded such that the inclination angle θ is formed. In an example, the material used for the first frame 9 was a Fe—Ni alloy (an invar alloy), and the protrusions 15 had a thin-walled columnar shape, a height of 0.2 mm and a diameter of 3.5 mm. Also, the protrusions 15 were formed so that the distance L from the edge 11*a* of the lateral portion 11 was 18 mm. The inclination angle θ was set to be 1.2°. The number of the protrusions 15 that were provided in the lateral portion 11 was eleven. Further, the distance between the adjacent protrusions 15 was set to be 55 mm.

By forming the joint portion 14 so as to be inclined with respect to the lateral portion 11 as described above, it is possible to provide the space (gap) between the joint portion 14 and the lateral portion 11. This space enlarges from the part where the joint portion 14 and the lateral portion 11 are joined (namely, the edge 14*a*) to the side of the bottom portion 12, in other words, with an increase in the distance from the edge 11*a* of the lateral portion 11. This allows the cleaning agent to enter the gap easily in the process of cleaning the first frame 9, so that foreign substances remaining in the first frame can be cleaned in a desired manner. Thus, it is possible to both suppress the deterioration of high-voltage withstand capabilities of the color cathode ray tube and prevent the poor welding in the process of welding the joint portion 104 and the lateral portion 11. Especially in a large-size color cathode ray tube with a 36-inch screen or the like, the joint portion 14 needs to be widened for the purpose of securing a welding strength, and thus, a lot of foreign substances including unwanted oil remain. Therefore, the effect of preventing the deterioration of high-voltage withstand capabilities of the color cathode ray tube according to the present embodiment is even more advantageous for large-size color cathode ray tubes.

Second Embodiment

Figure 5:
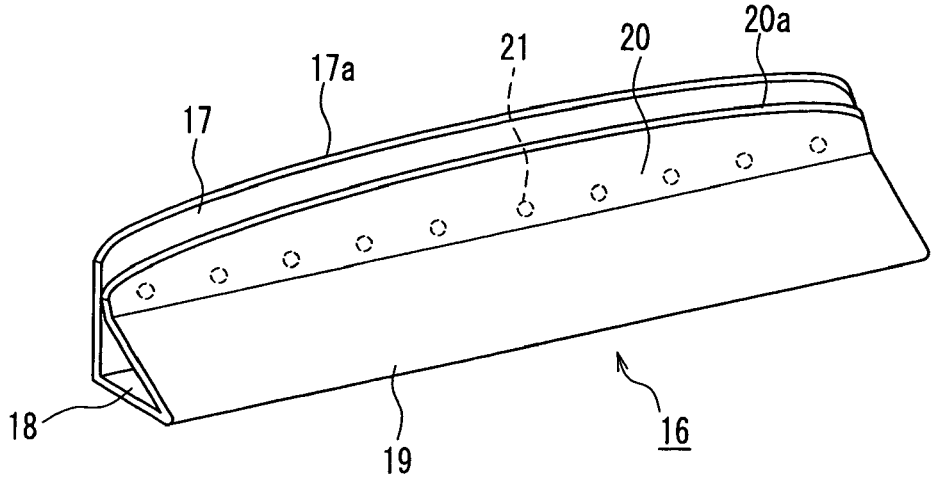
FIG. 5 is a perspective external view showing a first frame of a color cathode ray tube according to a second embodiment of the present invention.
Figure 6:
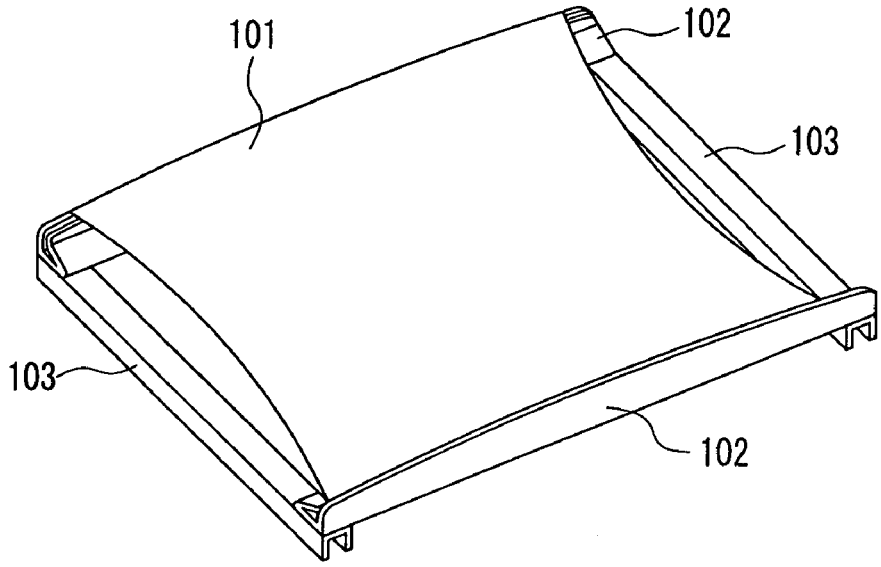
FIG. 6 PRIOR ART
FIG. 6 is a perspective external view showing a color selection mechanism of a conventional color cathode ray tube.
Figure 7:
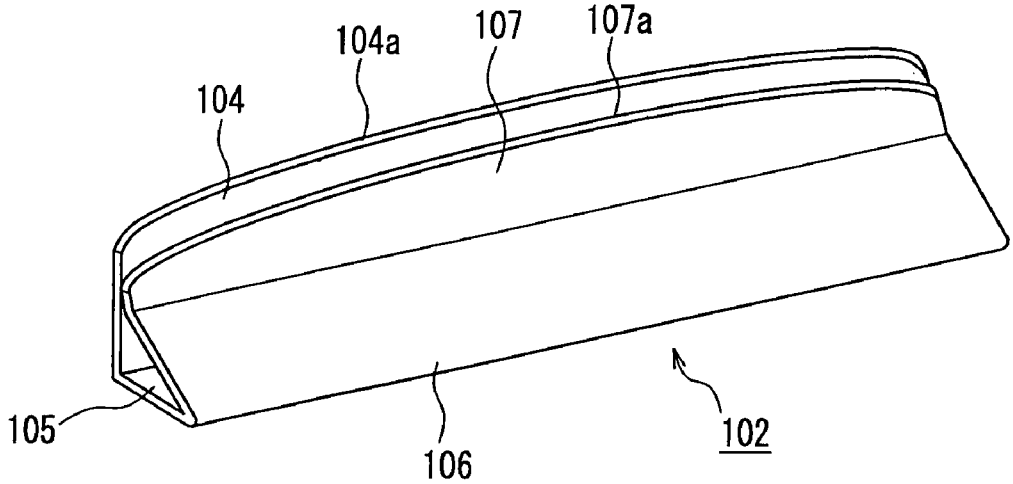
FIG. 7 PRIOR ART
FIG. 7 is a perspective external view showing a first frame of the conventional color cathode ray tube.

Now, the second embodiment of the color cathode ray tube according the present invention will be described referring to FIG. 5. FIG. 5 is a perspective external view showing a first frame of the color cathode ray tube according to the present embodiment.

As shown in FIG. 5, a first frame 16 of the color cathode ray tube according to the present embodiment also includes a lateral portion 17, a bottom portion 18, an inclined portion 19 and a joint portion 20.

The first frame 16 according to the present embodiment is characterized in that protrusions 21 provided on the surface of the lateral portion 17 of the first frame 16 are arranged along a straight line parallel with the longitudinal direction of the first frame 16 at positions facing the joint portion 20 near the border of the inclined portion 19 and the joint portion 20. The other configurations are similar to those in the first embodiment described above, and thus, the description thereof will be omitted here.

By providing the protrusions 21 along the straight line near the border of the inclined portion 19 and the joint portion 20 as described above, it is possible to increase the distance between the protrusion 21 and an edge 20*a*. Consequently, it becomes easier to achieve a close contact between the joint portion 20 and the lateral portion 17 at the edge 20*a*, thereby further improving a welding quality.

In the present embodiment, the distance L from an edge 17*a* of the lateral portion 17 supporting the shadow mask to the protrusion 21 was set to be 15 mm at the minimum at both ends and 23 mm at the maximum at the center, and the height of the protrusion 21 was set to be 0.2 mm. In this case, it is preferable that the height H of the protrusion 21 should be 0.05 mm<H<0.50 mm. If the height H is too small, a sufficient space cannot be secured, so that unwanted foreign substances tend to remain. If it is too large, it becomes difficult to achieve a close contact between the joint portion 20 and the lateral portion 17 at the edge 20*a*, so that poor welding tends to occur.

In the above-described color cathode ray tubes according to the first and second embodiments, the protrusions are provided in the lateral portion of the first frame so as to incline the joint portion with respect to the lateral portion. However, the protrusions may be provided not in the lateral portion but in the joint portion, thereby inclining the joint portion with respect to the lateral portion. Furthermore, the protrusions also may be provided in both the joint portion and the lateral portion.

Moreover, although the first and second embodiments have been directed to the configuration in which the first frame is formed by folding a plate material so as to form a substantially triangular cross-section by the lateral portion, the bottom portion and the inclined portion, the present invention is not limited to this configuration. As long as one substantially rectangular plate material is folded such that one longer side of this plate material to be on the side of the joint portion is overlapped on the other longer side thereof to be on the side of the lateral portion, the resulting cross-section may have a square shape, an elliptical shape, a circular shape or a waterdrop shape, instead of the triangular shape.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color cathode ray tube comprising:

a shadow mask;

first frames for supporting the shadow mask; and second frames for supporting the first frames;

wherein the first frames have a lateral portion for supporting the shadow masks, a bottom portion that is connected to one end of the lateral portion and bent with respect to the lateral portion, an inclined portion that is connected to one end of the bottom portion and bent with respect to the bottom portion, and a joint portion that is connected to one end of the inclined portion and bent with respect to the inclined portion, the first frames have a substantially triangular cross-section, which is formed by the lateral portion, the bottom portion, and the inclined portion, the joint portion is overlapped on the lateral portion and welded partially to the lateral portion, and a space is provided between facing surfaces of the lateral portion and a part of the joint portion other than the part welded to the lateral portion, the joint portion being inclined with respect to the lateral portion such that the space between the facing surfaces enlarges with an increase in a distance from an edge of the lateral portion on a side of supporting the shadow mask.

2. The color cathode ray tube according to claim 1, wherein a surface of one of the lateral portion and the joint portion facing the other has a protrusion that contacts the other.

3. The color cathode ray tube according to claim 2, wherein a plurality of the protrusions are provided.

4. The color cathode ray tube according to claim 3, wherein an edge of the joint portion that is welded to the lateral portion has an arc shape viewed from a normal direction of the joint portion, and the plurality of the protrusions are arranged along a straight line parallel with a longitudinal direction of the first frame.

* * * * *